United States Patent [19]

Bürgin

[11] Patent Number: 4,732,500

[45] Date of Patent: Mar. 22, 1988

[54] DRIVE MECHANISM INCLUDING FLOATING PRESSURE RING FOR INK RIBBON CASSETTE

[75] Inventor: Markus Bürgin, Monchaltorf, Switzerland

[73] Assignee: Franz Büttner AG, Egg, Switzerland

[21] Appl. No.: 792,370

[22] Filed: Oct. 29, 1985

[30] Foreign Application Priority Data

Nov. 23, 1984 [CH] Switzerland ..... 5616/84

[51] Int. Cl.[4] ..... B41J 32/00

[52] U.S. Cl. ..... 400/208; 400/234; 400/235.1; 400/636; 400/641; 226/181

[58] Field of Search ..... 400/194, 195, 196, 196.1, 400/207, 208, 208.1, 234, 235.1, 636, 641; 226/39, 181, 185, 186, 187, 191, 194; 242/192, 199, 200; 352/78 R, 78 C

[56] References Cited

U.S. PATENT DOCUMENTS

| | | | |
|---|---|---|---|
| 1,998,931 | 4/1935 | Kellogg | 226/186 X |
| 3,042,281 | 7/1962 | Balvin et al. | 226/181 |
| 3,100,591 | 8/1963 | Trimble | 226/39 |
| 3,186,195 | 6/1965 | Braun | 226/181 X |
| 3,411,686 | 11/1968 | Bender | 400/235.1 X |
| 3,804,227 | 4/1974 | Cappotto | 400/208 |
| 3,854,804 | 12/1974 | McMaster | 352/78 R |
| 4,011,933 | 3/1977 | Kern | 400/208 |
| 4,213,716 | 7/1980 | Carson, Jr. | 400/196.1 |
| 4,252,450 | 2/1981 | Goodman et al. | 400/208 |
| 4,269,520 | 5/1981 | Gabler | 400/196 |
| 4,428,695 | 1/1984 | Jamieson | 400/208 X |
| 4,465,388 | 8/1984 | Iwasawa | 400/235.1 X |
| 4,490,059 | 12/1984 | Daughters | 400/235.1 X |
| 4,568,210 | 2/1986 | Privitera | 400/235.1 |

FOREIGN PATENT DOCUMENTS

| | | | |
|---|---|---|---|
| 946024 | 7/1956 | Fed. Rep. of Germany . | |
| 0029485 | 2/1982 | Japan | 400/196.1 |

*Primary Examiner*—Ernest T. Wright, Jr.
*Attorney, Agent, or Firm*—Blum Kaplan

[57] ABSTRACT

An improved drive mechanism for an ink ribbon cassette for advancing an ink ribbon particularly well suited for use in a typewriter is provided. The drive mechanism includes a drive roller rotatably supported in the casing with a free floating pressure ring supported by a roller. The pressure ring is supported against the roller and against the drive roller so that there is an increase in pressure with an increase in the tension of the ribbon.

13 Claims, 6 Drawing Figures

FIG. 1
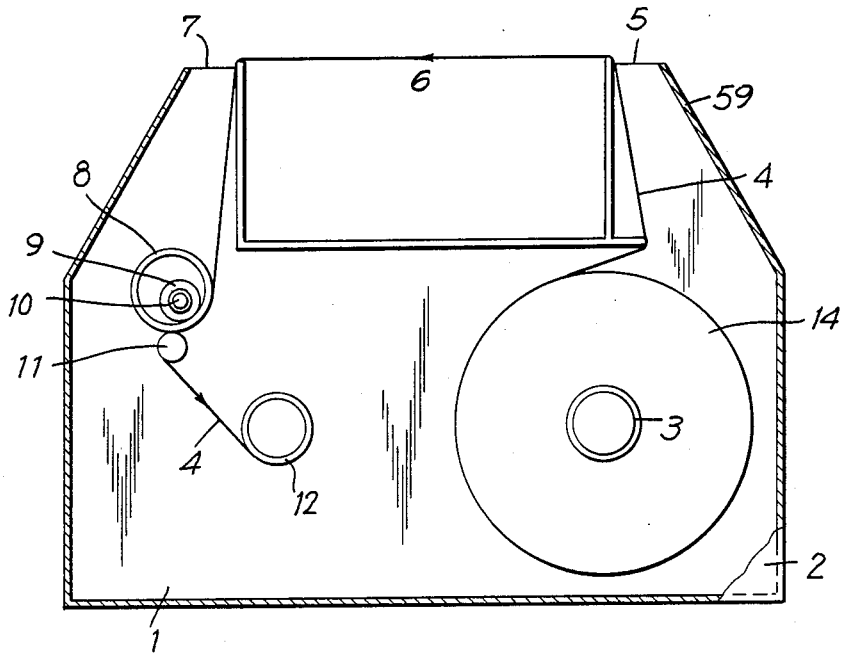
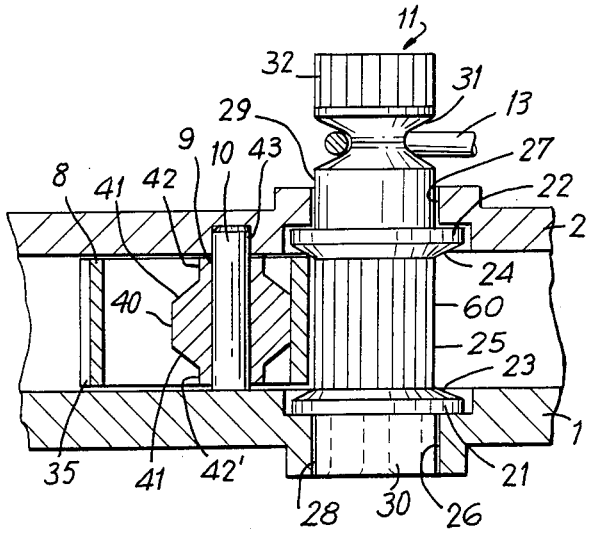
FIG. 2
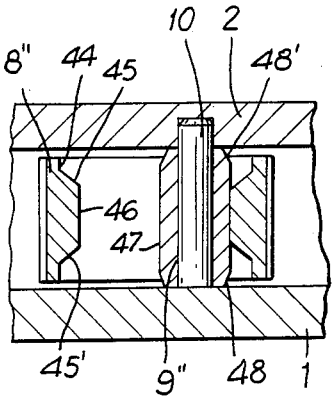
FIG. 3

FIG. 4
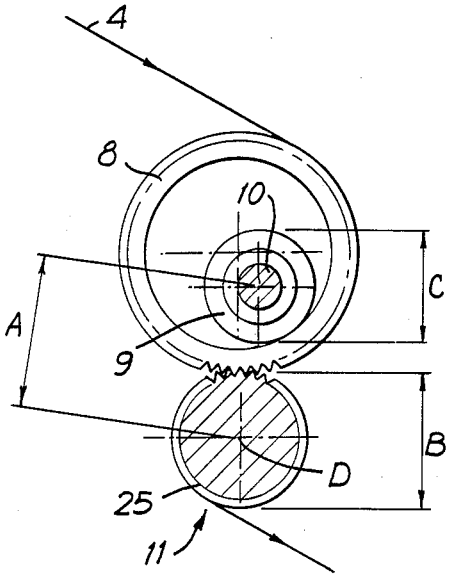
FIG. 5
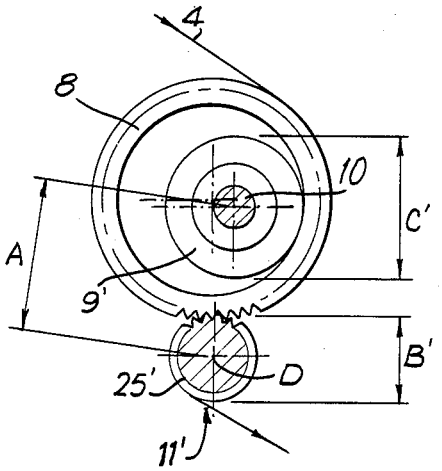
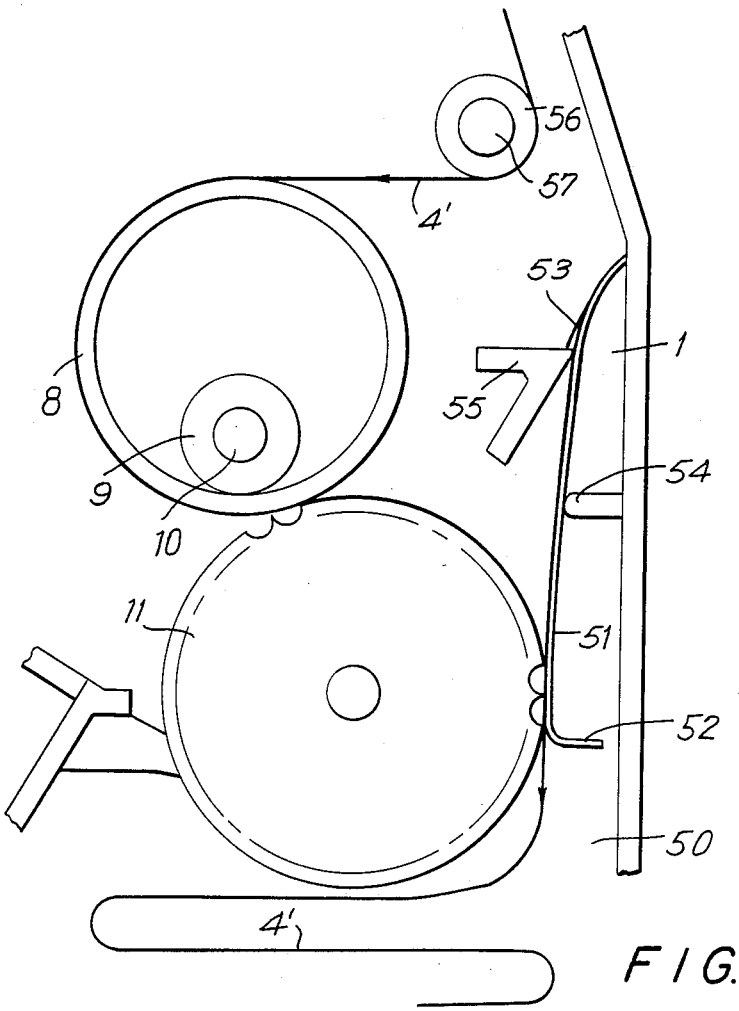
FIG. 6

DRIVE MECHANISM INCLUDING FLOATING PRESSURE RING FOR INK RIBBON CASSETTE

BACKGROUND OF THE INVENTION

This invention relates in general to ribbon drive mechanisms, and in particular, to ribbon drive mechanisms for ink ribbons employed in a ribbon cartridge in printing applications.

Ribbon drive mechanisms are known in the art as disclosed in U.S. Pat. No. 4,011,933. This prior art cassette has a drive roller with a driver supported in fixed position in the cassette casing and a free floating pressure ring on a bearing stud with play between the pressure ring and the driver. The drive roller is positioned on the receiving or rolling-up side of the bearing stud and pulls the ink ribbon from a storage roll within the cassette through a printing location. Tension of the ribbon wedges the pressure ring between the bearing stud and the driver to create pressure of the pressure ring on the drive roller with the frictional connection between ribbon and drive roller increasing with increasing ribbon tension.

This prior art mechanism has been satisfactory; however, it suffers from the disadvantage that threading of the ink ribbon between the pressure ring and drive roller is very difficult when the drive roller has flanges to guide the ink ribbon which necessarily overlap the pressure ring. Another disadvantage is the sliding friction of the pressure ring on the bearing stud, which also increases with increasing ribbon tension. Because of this undesirable sliding friction, the pressure ring must have a low coefficient of friction, which greatly limits the material selection. It is also desirable that for interchangeable uses of the ink ribbon to provide a cassette which can be used at different ribbon advance speeds. This necessitates using drive rollers having different diameters. This is possible in the known cassette only by shifting the position of the bearing stud in relation to the axis of the drive roller. Therefore, such a solution requires another casing for each reduction or speed change.

Accordingly, it is desireable to provide a drive mechanism for an ink ribbon cassette which overcomes the shortcomings of the prior art device described above.

SUMMARY OF THE INVENTION

Generally speaking, in accordance with the invention, an ink ribbon cassette having an improved drive mechanism for advancing an ink ribbon is provided. The cassette includes a drive roller mounted on the cassette casing with a bearing stud mounted adjacent thereto. A roller is mounted for rotation about the bearing stud with a pressure ring supported on its inner surface by the roller and on its outer surface by the drive roller. The pressure increases with an increase in tension on the ribbon.

It is an object of this invention to provide an improved drive mechanism for an ink ribbon cassette.

Another object of this invention is to provide a drive mechanism for an ink ribbon cassette which has conical surfaces to facilitate threading the ink ribbon between the prssure ring and drive roller.

A further object of this invention is to provide a drive mechanism for an ink ribbon cassette which reduces the sliding friction on the pressure ring as ribbon tension increases.

Still another object of this invention is to provide a drive mechanism for an ink ribbon cassette which will allow the cassette casing to be used with rollers of different sizes and operate at various ribbon winding speeds.

Still other objects and advantages of the invention will in part be obvious and will in part be apparent from the specification and drawings.

The invention accordingly comprises features of construction, combination of elements, and arrangement of parts which will be exemplified in the construction hereinafter set forth and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a top plan view of an ink ribbon cassette in accordance with the invention with the cover partially removed;

FIG. 2 is an enlarged cross-sectional view through a drive roller of the cassette depicted in FIG. 1;

FIG. 3 is a cross-sectional view of a drive roller constructed in accordance with an alternate embodiment of the invention;

FIG. 4 is a top plan view of the drive mechanism of the ribbon advance of FIG. 1;

FIG. 5 is a top plan view of a drive mechanism in accordance with another embodiment of the invention; and FIG. 6 is a top plan view of an ink ribbon drive mechanism in accordance with an alternative embodiment of the invention for use with an endless ink ribbon.

DETAILED DESCRIPTION OF THE PREFERRED EMBODIMENTS

Reference is made to FIG. 1, wherein a plan view of an ink ribbon cassette constructed in accordance with the invention is shown. The cassette includes a casing base 1 and a casing cover 2 supported by a side wall 59, a portion of which is shown. A supply roll 14 of an ink ribbon 4 is wound on core 3 supported within casing cover 2 and base 1. Roll 14 is braked against casing cover 2 and base 1 to provide a definite ribbon tension. Ink ribbon 4 wound on supply roll 14 unwinds through an outlet 5 and advances in the direction of the arrows to a location 6 and drawn into an inlet opening 7 by means of a drive mechanism to a winding core 12 also supported within casing base 1 and cover 2.

The drive mechanism includes a drive roller 11 mounted for rotation within casing cover 2 and casing base 1 with ink ribbon 4. Ink ribbon 4 is pressed against drive roller 11 by a pressure ring 8 with ink ribbon 4 also wrapped thereabout. Pressure ring 8 is free floating about the roller 9 which is supported in rotary arrangement on a bearing stud 10 attached to the casing base 1 and cover 2. Pressure ring 8 is supported by the force exerted upon it at its outer surface by drive roller 11 and the force exerted on its inner surface by roller 9. The internal diameter of pressure ring 8 is substantially larger than the external diameter of roller 9 so that pressure ring 8 surrounds roller 9 with considerable play. The pressing force of pressure ring 8 against drive roller 11 is dependent on the tension of ink ribbon 4 between inlet opening 7 and pressure ring 8. As ink ribbon 4 advances, pressure ring 8 rolls on roller 9, which produces a light friction.

As is seen from FIG. 2, drive roller 11 is rotatably supported by a lower cylindrical stud 28, in a staged borehole 26 formed in casing base 1 and by an upper cylindrical stud 29 in a staged borehole 27 formed in cover 2. In order to guide ink ribbon 4, drive roller 11 includes lower and upper flanges 21,22 with conical shoulders 23,24 on both sides of a meshed central drive cylinder 25. Drive roller 11 also has a catch coupling 30 for driving drive roller 11 in a typewriter, for example. The portion of drive roller 11 projecting above cover 2 includes a handwheel 32 as well as a groove 31, into which a rubber belt 13 is inserted for driving winding core 12. Pressure ring 8 is formed with gearing 35 which meshes with gearing 60 formed on drive cylinder 25.

As further shown by FIG. 2, roller 9 is designed symmetrically to its radial median plane with a central cylindrical region tapering on both sides of the cylindrical pressure surface 40, extending to upper and lower cylindrical surfaces 42 and 42'. The difference between the radii of surface 40 and upper and lower cylindrical surfaces 42 and 42' is greater than the radial width of flanges 21,22. The result achieved is that ink ribbon 4 can be inserted effortlessly from above between pressure ring 8 and drive cylinder 25 with roller 9 removed and pressure ring 8 pressed against bearing stud 10. It is also possible to isnert drive roller 11 in axial direction into base 1 with ink ribbon 4 in place. In both cases, roller 9 is subsequently placed on bearing stud 10, whereby pressure ring 8 is automatically displaced between flanges 21,22 by cone 41. The assembly of the drive mechanism is substantially facilitated in both cases in comparison with the the prior art.

Reference is next made to FIG. 3, which shows a bearing stud 10 with a roller 9'' and a pressure ring 8'' which essentially corresponds to that of FIG. 2. In this embodiment, pressure ring 8'' is formed with conical surfaces instead of roller 9''. Pressure ring 8'' has a central cylindrical inside surface 46 which extends both upwardly and downwardly to cones 45 and 45' and finally into an expanded cylindrical element 44. Roller 9'' includes a cylindrical pressure surface 47 which extends in both directions into conically tapered surfaces 48 and 48'. Here, too, the radial displacement of pressure ring 8'' attainable by conical surfaces 45 and 48 is greater than the radial width of flanges 21 and 22.

Reference is next made to FIGS. 4 and 5, wherein two ink ribbon winding mechanisms for winding at different speeds are shown while maintaining an interval A between bearing stud 10 and a drive roller center D. Drive roller 11 of FIG. 4 with a diameter B is replaced by another drive roller 11' with a smaller diameter B' of drive cylinder 25' and, at the same time, replacing roler 9 having a diameter C with roller 9' having a diameter C'. This arrangement of components permits use of the same casing base 1 and cover 2 to provide drive mechanisms which operate at different speeds while utilizing the same pressure ring 8.

Referring now to FIG. 6, another embodiment of the invention is shown for a cassette with an endless textile inked ribbon 4', which is drawn in the direction of the arrow by roller 56 from an inlet (not shown). Roller 56 is supported on casing base 1 by a pin 57 attached to casing base 1. The drive mechanism again includes pressure ring 8, free-floating on roller 9 and drive roller 11. Roller 9 is supported on bearing stud 10. Ink ribbon 4' is wrapped around pressure ring 8 and drive roller 11 along a portion of its circumference and is pressed against drive roller 11 at the outlet end by spring 51. Spring 51 is biased towards drive roller 11 by a pressure lug 54 and a support 55 attached to the cassette and is secured against longitudinal displacement by retention leg 53. Ink ribbon 4' is fed loosely to a storage region 50 in loose sliding by the drive mechanism. Spring 51 is formed with a leg 52 to prevent penetration of free ribbon 4' into the drive side of the drive mechanism.

Roller 9 is supported on bearing stud 10 which is inserted into a borehole 43 in casing cover 2 in the manner shown in FIG. 2. However, it is also possible to connect bearing stud 10 rigidly with roller 9 thereabout and have it supported in rotary arrangement in base 1 and in borehole 43 or fixed to cover 2 and in a corresponding borehole in base 1.

Accordingly, by providing a drive mechanism including a bearing stud with a roller mounted thereon and a free-floating pressure ring for compressing a winding ribbon against a drive roller both assembly and operation are enhanced. Additionally, by providing conical surfaces on the exterior surface of the roller mounted on the heavy stud or on the interior surface of the pressure ring, the roller may be readily inserted into place even when the ribbon is biased against the pressure ring. Finally, the drive mechanism in accordance with the invention is particularly well suited to provide for using the same casing to provide for different winding speeds as the distance between the bearing stud and drive roller remains constant while varying the diameters of the roller and the drive cylinder of the drive roller.

It will thus be seen that the objects set forth above, among those made apparent from the preceding description, are efficiently attained and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an ink ribbon cassette having a top, a bottom, a side wall connecting the top and bottom and an ink ribbon supply means, an improved ink ribbon drive mechanism comprising:

a rotatably supported driver;

a freely rotating roller mounted within the cassette adjacent to the driver; and a pressure ring having an internal diameter larger than the external diameter of the roller mounted about the roller with a portion of the inner surface of the ring contacting the roller and a portion of the outside surface of the ring contacting the driver, the pressure ring, the rotating roller and the driver positioned in the housing so that a ribbon fed from the ribbon supply means contacts a portion of each of the pressure ring and driver for advancing the ribbon past the ring and driver with the pressure on the ribbon increasing in response to an increase in tension on the ribbon.

2. The ink ribbon cassette of claim 1, further including a bearing stud mounted within the cassette and the roller supported about the bearing stud.

3. The ink ribbon cassette of claim 1, wherein the roller includes a central cylindrical portion having a first diameter and at least one portion of a reduced diameter at least at one end of the roller and a conically tapered section between the portions of the first and the reduced diameters.

4. The ink ribbon cassette of claim 3, wherein the roller includes a portion of reduced diameter at both ends thereof with conically tapered sections between the cylindrical portion and the portions of reduced diameter.

5. The ink ribbon cassette of claim 1, wherein the inner surface of the pressure ring is formed with a region which is substantially cylindrical having a first diameter and at least one end of the ring a region having a larger diameter with a conically tapered surface between the cylindrical region of first diameter and the region of enlarged diameter.

6. The ink ribbon cassette of claim 5, wherein the inner surface of the pressure ring is formed with regions of larger diameter at both ends of the ring with conically tapered regions between the region of the first diameter and the regions of larger diameter.

7. The ink ribbon cassette of claim 1, wherein the driver is formed with a central drive cylindrical region about which the ink ribbon from the supply means is wound and formed with flanges at both ends of the central drive cylindrical region for guiding the ink ribbon about the central drive cylindrical region.

8. The ink ribbon cassette of claim 7, wherein the roller is formed with a central cylindrical region having a cylindrical surface of a first diameter which tapers conically to at least one end of the roller and wherein the difference between the radius at the cylindrical surface of a first diameter and the radius at the at least one tapered end is at least as large as the radial width of the flanges.

9. The ink ribbon cassette of claim 7, wherein the outer surface of the pressure ring is formed with a geared surface and the central drive cylindrical region of the driver is formed with a geared surface, the geared surfaces of the pressure ring and driver cooperating for advancing an ink ribbon therebetween.

10. The ink ribbon cassette of claim 1, further including a winding core rotatably mounted within the cassette, the driver operatively coupled to the winding core for winding a ribbon thereon which has been fed between the pressure ring and driver.

11. The ink ribbon cassette of claim 1, wherein the cassette includes an ink ribbon storage region for receiving an ink ribbon driven between the roller and driver.

12. The ink ribbon cassette of claim 11, further including biasing means mounted within the cassette for biasing against the driver and against the ribbon being wound about the driver and positioned to prevent ribbon entering the storage region from entering another region of the cassette.

13. An ink ribbon cassette having a top, a bottom, a side wall connecting the top and bottom in an ink ribbon supply means, an improved ink ribbon winding mechanism comprising:

a rotatably supported driver;

a bearing stud mounted within the cassette adjacent to the driver;

a freely rotating roller mounted for rotation on the bearing stud and formed with a central cylindrical portion and region of reduced diameter at both ends thereof with conically tapered regions between the cylindrical portion and the regions of reduced diameter;

a pressure ring having an internal diameter larger than the external diameter of the roller mounted about the roller and a portion of the outside surface of the ring contacting the driver, the pressure ring, the rotating roller and the driver positioned in the housing so that a ribbon fed from the ribbon supply means contacts a portion of each of the pressure ring and driver for advancing the ribbon past the ring and driver with the pressure on the ribbon increasing in response to an increase in tension on the ribbon; and a winding core mounted for rotation within the cassette, the driver formed with a central driver cylindrical region about which an ink ribbon from the supply means is wound and formed with flanges at both ends of the central drive cylindrical region for guiding the ink ribbon about the central drive cylindrical region, the driver being operatively coupled to the winding core for rotating the winding core.

* * * * *